US007189010B1

(12) United States Patent
Tomikawa et al.

(10) Patent No.: US 7,189,010 B1
(45) Date of Patent: Mar. 13, 2007

(54) DATA LINK MODULE

(75) Inventors: Ichiro Tomikawa, Ebina (JP); Naoshi Kotake, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/540,588

(22) Filed: Oct. 2, 2006

(30) Foreign Application Priority Data

Jan. 4, 2006 (JP) ..... 2006-000186

(51) Int. Cl.
*G02B 6/36* (2006.01)

(52) U.S. Cl. ..... 385/88; 439/76.1

(58) Field of Classification Search ..... 385/88, 385/89, 49, 92, 94, 53, 14, 15, 51; 439/577, 439/76.1
See application file for complete search history.

(56) References Cited

U.S. PATENT DOCUMENTS 4,647,765 A * 3/1987 Imaizumi et al. ..... 250/227.11
6,447,174 B1 * 9/2002 Trezza ..... 385/89
7,121,722 B2 * 10/2006 Hanzawa et al. ..... 374/185
7,128,472 B2 * 10/2006 Benner et al. ..... 385/88
2002/0025122 A1 * 2/2002 Ouchi et al. ..... 385/88
2002/0114587 A1 * 8/2002 Golwalkar et al. ..... 385/88
2002/0114588 A1 * 8/2002 Golwalkar et al. ..... 385/88

FOREIGN PATENT DOCUMENTS

JP 2005-51729 2/2005

* cited by examiner

*Primary Examiner*—J. F. Duverne
(74) *Attorney, Agent, or Firm*—Morgan, Lewis & Bockius LLP

(57) ABSTRACT

A data link module includes: a cable comprising an electric wire and optical fibers aligned with each other; a substrate disposed at one end of the cable; signal medium conversion elements performing conversion between an electric signal and an optical signal; an electric terminal that is electrically connected to the electric wire of the cable; and an electric connector that is electrically connected to the signal medium conversion elements and the electric terminal respectively.

3 Claims, 5 Drawing Sheets

DATA LINK MODULE

BACKGROUND (i) Technical Field

The present invention relates to a data link module that links devices through a cable comprising a bundle formed by combining optical fibers and an electric wire.

(ii) Related Art

Recent developments of high speed communication has spread the use of data link modules that link devices through a cable consisting of a single bundle formed by combining optical fibers for transmitting an optical signal and electric wires for transmitting a control signal and supplying power.

SUMMARY

According to one aspect of the present invention, a data link module includes: a cable comprising a bundle formed by combining an electric wire and plural optical fibers aligned with each other;

a substrate disposed at one end of the cable, the one end face of the substrate facing a direction that the cable extends;

plural signal medium conversion elements performing conversion between an electric signal and an optical signal, the signal medium conversion elements being arranged in one of a top face and a back face of the substrate, at a position substantially close to the one end face of the substrate where the signal medium conversion elements are optically connected to the optical fibers of the cable respectively;

an electric terminal that is arranged at the other one of the top face and the back face of the substrate, at a position substantially close to the one end face of the substrate so as to correspond to and be electrically connected to the electric wire of the cable; and an electric connector that is adapted to be connected with a mating electrical connector, the electrical connector being disposed at a position substantially close to an end face opposite to the one end face of the substrate and is electrically connected to the signal medium conversion elements and the electric terminal respectively.

BRIEF DESCRIPTION OF THE DRAWINGS

Exemplary embodiment(s) of the present invention will be described in detail based on the following figures, wherein.

DETAILED DESCRIPTION

Exemplary embodiment(s) of the invention will be described below with reference to the accompanying drawings.

Figure 1:
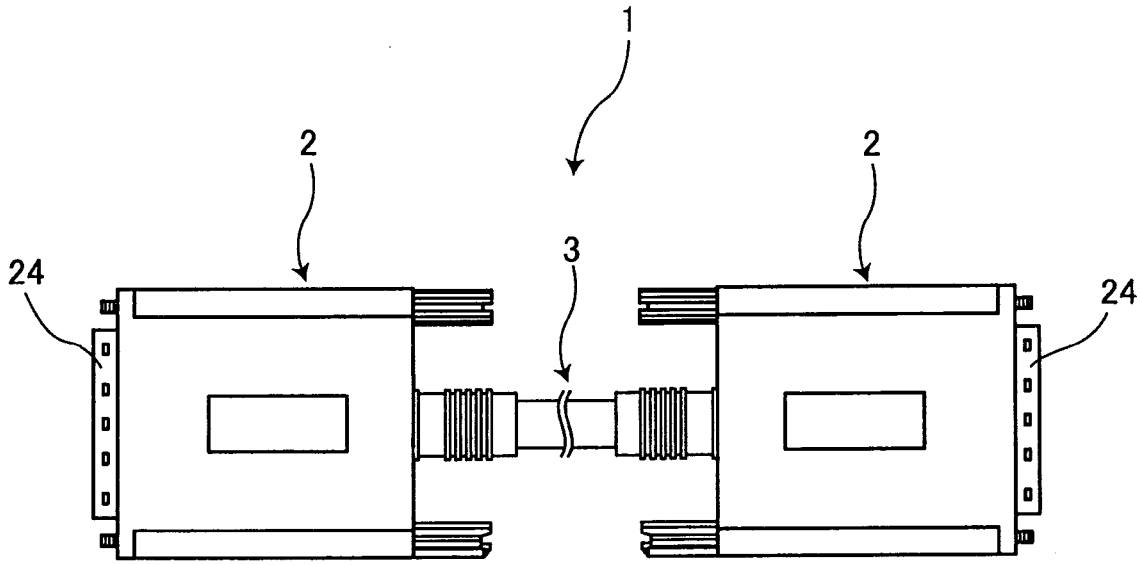
FIG. 1 shows an external perspective view of a data link module according to one exemplary embodiment of the invention.

FIG. 1 shows an external perspective view of a data link module 1 according to one exemplary embodiment of the invention.

Referring to FIG. 1, the data link module 1 is capable of transmission of both an electric signal and an optical signal between devices and has a cable 3 and connectors 2 attached to the ends of the cable 3. The cable 3 is a single bundle that eight electric wires and four optical fibers are combined into.

FIG. 1 also shows an electrical connector 24 disposed at the tip of each of the connectors 2, which will be described later in detail, that is to be connected to an external device.

Figure 2:
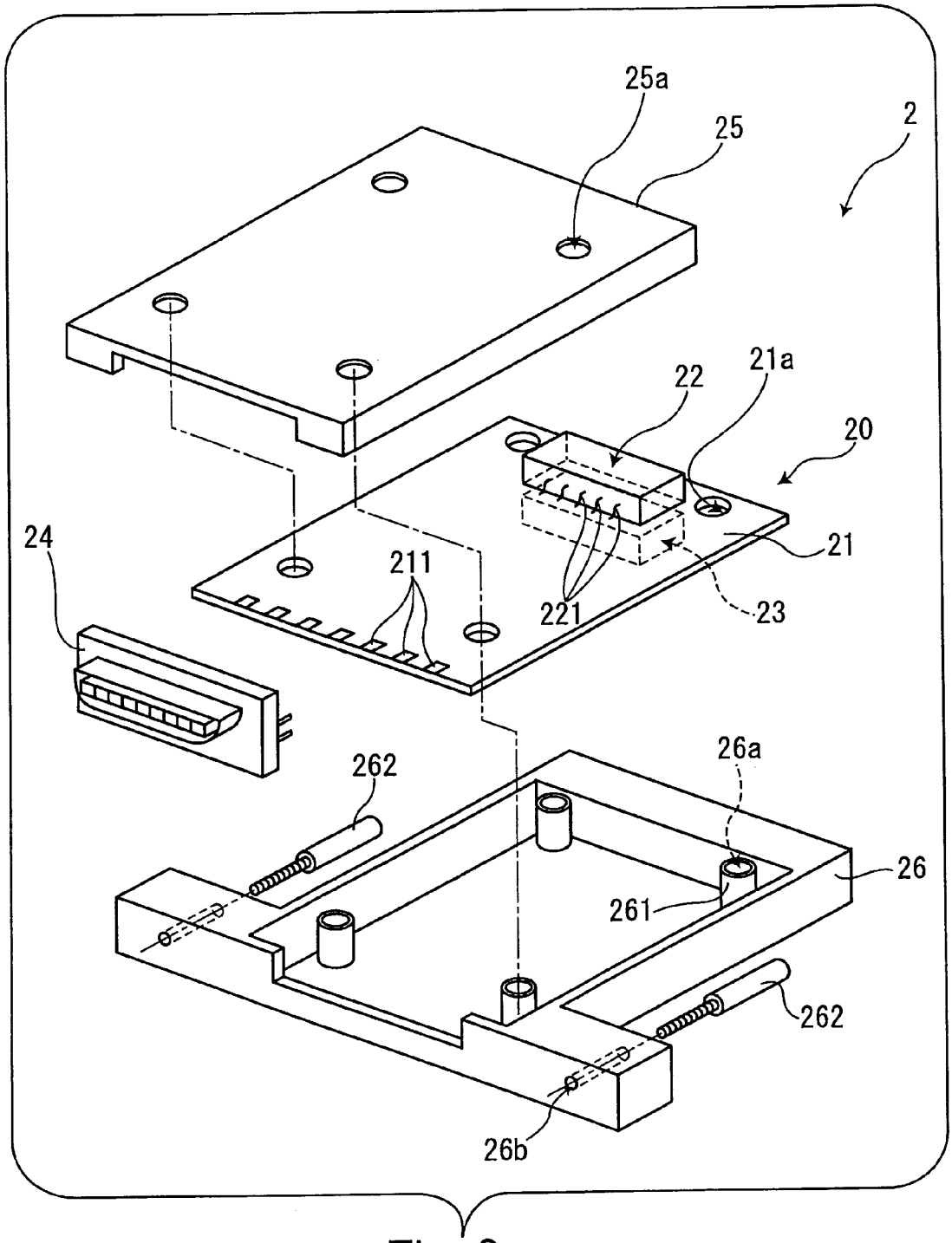
FIG. 2 shows a perspective exploded view of a connector shown in FIG. 1.

FIG. 2 shows a perspective exploded view of the connector 2 shown in FIG. 1.

Referring to FIG. 2, the connector 2 is composed of a housing body 26, a cover 25 and a substrate 20 to be accommodated in the housing body 26 and the cover 25.

The substrate 20 has a substrate body 21, an LED (Light Emitting Diode) section 22, an electric terminal section 23 and the electrical connector 24. The LED section 22 is disposed on the top face of the substrate body 21 close to the end face thereof that is connected to the cable 3 shown in FIG. 1, while the electric terminal section 23 is disposed on the back face of the substrate body 21. The electrical connector 24 is disposed, for connection with an external device, on the substrate body 21 close to the end face opposite to the end face of the substrate body 21 connected to the cable 3.

Electric wires are mounted on the top and back faces of the substrate body 21. Thus, LEDs 222 of the LED section 22 and electric terminals 231 of the electric terminal section 23 (see FIG. 3) are electrically connected to the electric wires mounted on the substrate body 21. FIG. 2 also shows wires 221 that link the electric wires mounted on the substrate body 21 to the LEDs 222 of the LED section 22.

On the top and back faces of the substrate body 21, contacts 211 are provided for connection with the electrical connector 24 at the end face opposite to the end face of the substrate body 21 connected to the cable 3. The contacts 211 are connected to the electric wires mounted on the substrate body 21. Thus, the electrical connector 24 is electrically connected to the LEDs 222 and the electric terminals 231 through the contacts 211. The LEDs are an example of "signal medium conversion elements" according to the exemplary embodiment. The substrate body 21 has holes 21*a* formed therein for positioning when accommodated in the housing body 26.

The housing body 26 has bosses 261 disposed on its internal bottom face. The bosses 261 each have a thread groove therein. When the connector 2 is assembled, the substrate body 21 is first fitted in the housing body 26 by inserting the bosses 261 through the holes 21*a* of the substrate body 21, and then the cover 25 is put on the substrate body 21 and the housing body 26. The connector 2 is fastened by turning screws (not shown) into holes 25*a* formed in the cover 25. Additionally, the housing body 26 has holes 26*b* formed therein at positions to have the electrical connector 24 interposed between the holes 26*b* when the substrate body 21 is accommodated in the housing body 26. Lock screws 262 are inserted through the holes 26*b* to secure engagement of the electrical connector 24 with a mating connector.

Figure 3:
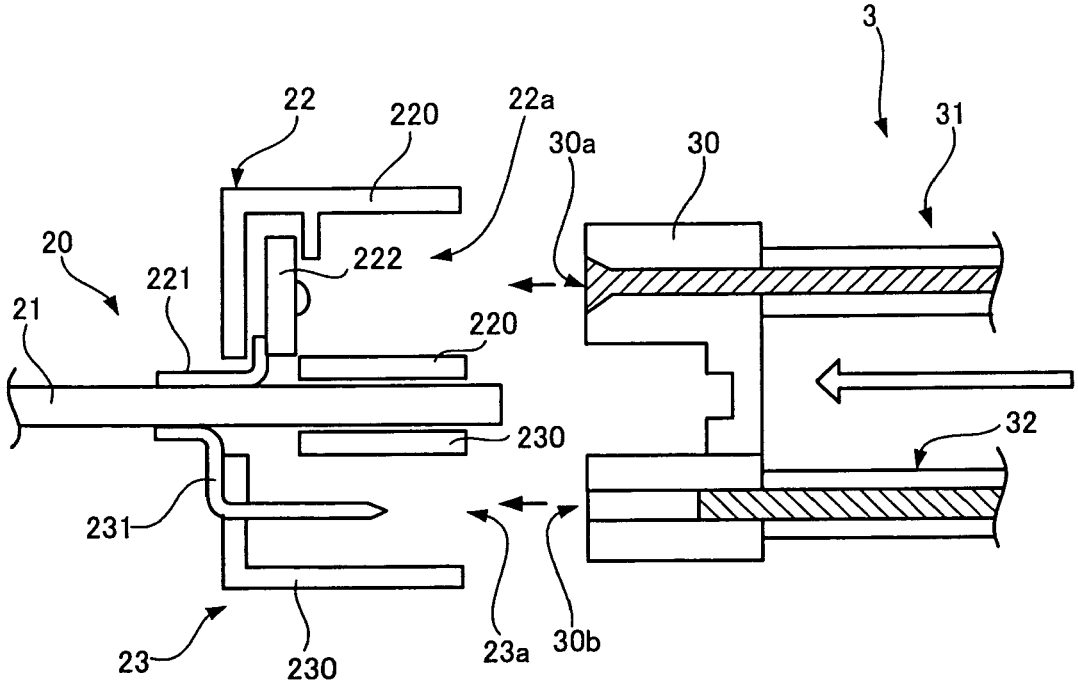
FIG. 3 shows a sectional view taken at the portion where the connector shown in FIG. 2 and the cable shown in FIG. 1 is connected.

FIG. 3 shows a sectional view taken at the portion where the connector 2 shown in FIG. 2 and the cable 3 shown in FIG. 1 are connected.

FIG. 3 shows the LED section 22 fixed to the top face of the substrate body 21. The LED section 22 is composed of the LEDs 222 and a frame 220.

FIG. 3 also shows the electric terminal section 23 fixed to the back face of the substrate body 21. The electric terminal section 23 is composed of the electric terminals 231 and a frame 230.

Further, FIG. 3 shows the cable 3 that includes optical fibers 31, electric wires 32 and a ferrule 30. The ferrule 30 has an insertion hole 30*a* into which the ends of optical fibers 31 are inserted and an insertion hole 30*b* into which the ends of electric wires 32 are inserted.

The frame 220 of the LED section 22 and the frame 230 of the electric terminal section 23 respectively have engagement portions 22*a* and 23*a* to receive the ferrule 30, so that optical connection between the LEDs 222 and the optical fibers 31, and electrical connection between the electrical terminals 231 and the electric wires 32 are enabled when the ferrule 30 is inserted into the engagement portions 22*a* and 23*a*.

Although the data link module 1 according to the exemplary embodiment is capable of handling both optical transmission and electrical transmission, the portion linking the module 1 to an external device is limited only to the electrical connector 24. Accordingly, the number of times that the module 1 performs engagement is decreased to half a conventional module capable of both optical transmission and electrical transmission, which requires operations for engagement, at least twice for optical connection and electrical connection. Therefore, the data linking module 1 reduces labor in linking devices. Furthermore, as the connector 2 is connected to the cable 3 easily only by inserting the ferrule 30 into the engagement portions 22*a* and 23*a*, it is also easy to replace the cable 3.

Further, in order to reduce the thickness of the substrate 20, the four LEDs 222 in the LED section 22 are configured to be aligned along the side of the substrate body 21 so as to be connected to the electric wires mounted on the top face of the substrate body 21. For the same reason, the eight electric terminals 231 of the electric terminal section 23 are aligned along the side of the substrate body 21 so as to be connected to the electric wires mounted on the back face of the substrate body 21.

Figure 4:
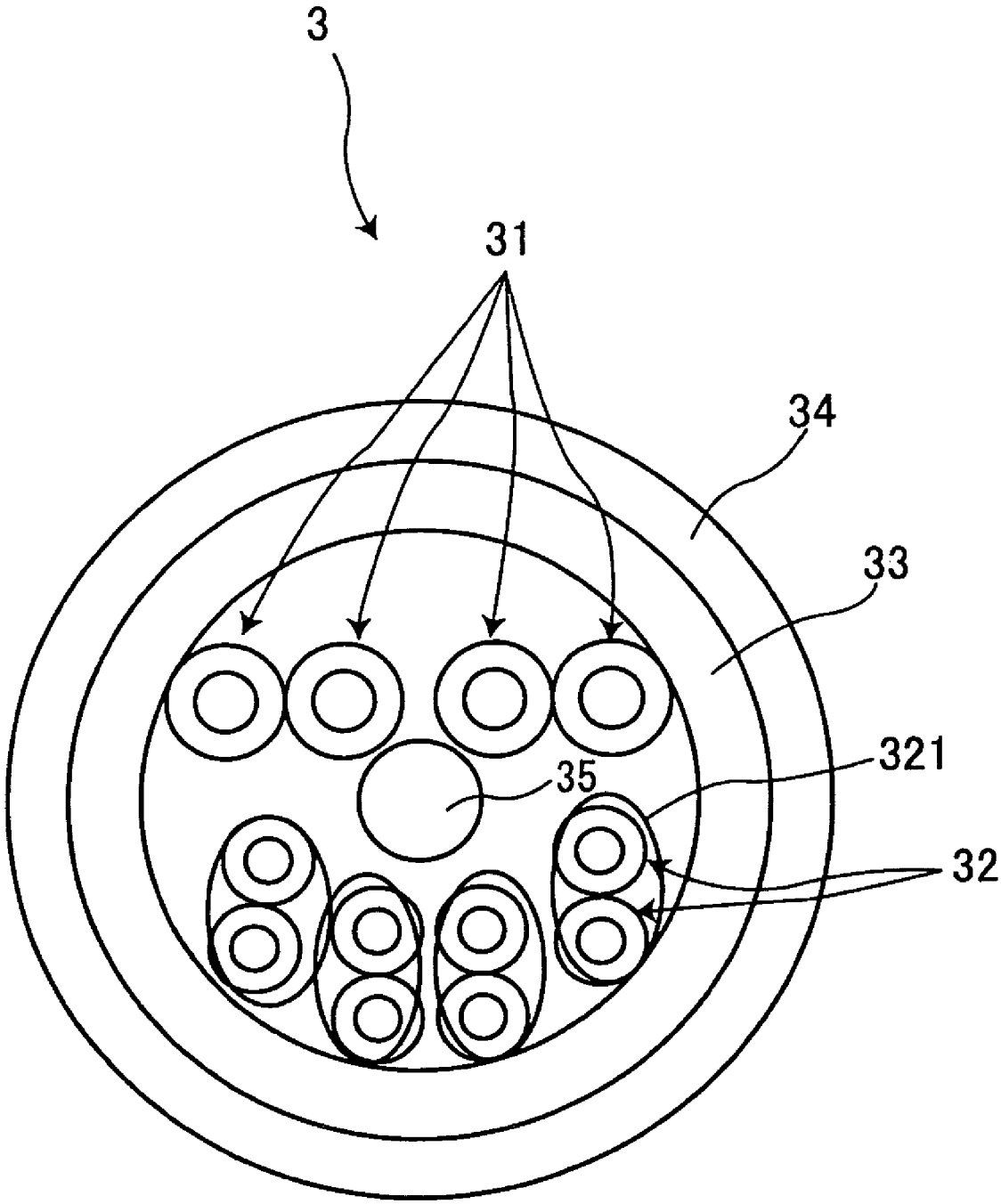
FIG. 4 shows a sectional view of the cable shown in FIG. 1.

FIG. 4 shows a sectional view of the cable 3 shown in FIG. 1.

As shown in FIG. 4, a core material 35 is inserted in the cable 3 such that the four optical fibers 31 are aligned with each other in the cable. The four optical fibers 31 and the four sets of two electrical wires 32 enveloped with aluminum foil 321 are covered with a metallic shield 33, which is further covered by a sheath 34.

As described earlier, in order to reduce the thickness of the substrate 20, the LEDs 222 and the electrical terminals 231 of the data link module 1 are aligned along the side of the substrate body 21. The optical fibers 31 are aligned with each other in the cable 3 so as to positionally correspond to the aligned LEDs 222, thereby preventing occurrence of transmission error due to distortion of the optical fibers 31.

Additionally, electromagnetic noise is securely shielded by the aluminum foil 321 that encloses each set of two electric wires 32 and further by the metallic shield 33.

Figure 5A:
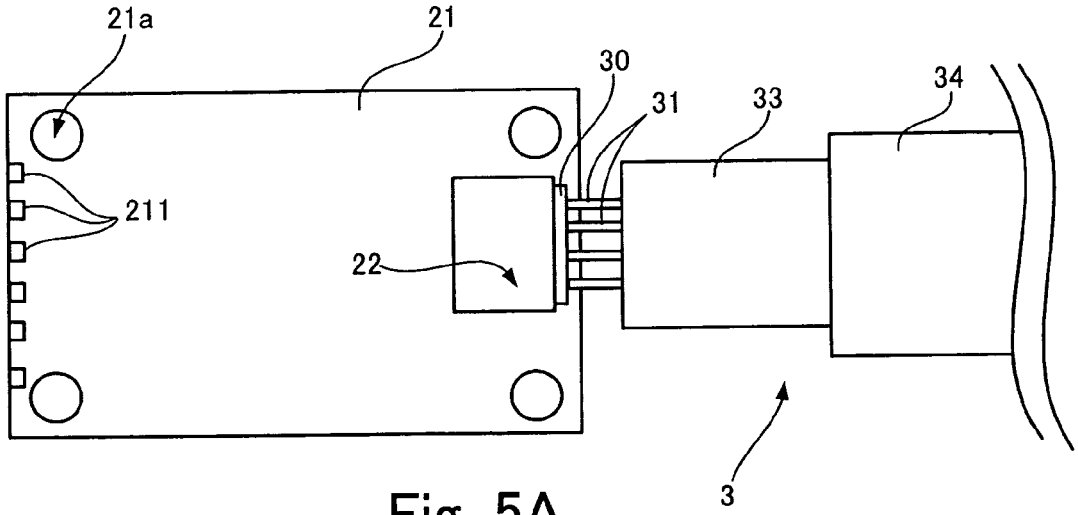
FIGS. 5A through 5C show connection between a substrate and the cable.
Figure 5B:
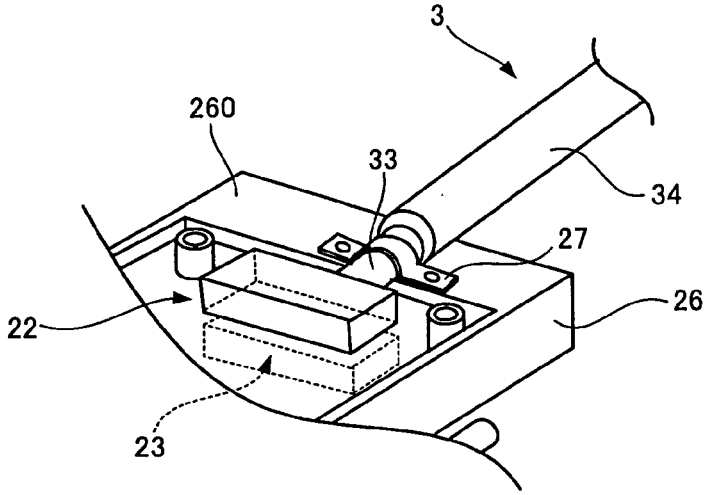
Figure 5C:
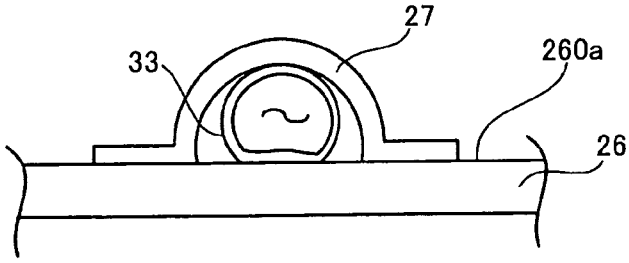

FIGS. 5A through 5C show connection between the substrate 20 and the cable 3.

FIG. 5A is a top view, viewed from the cover 25, of connection between the substrate 20 and the cable 3 when the ferrule 30 is received by the engagement portions 22*a* and 23*a* respectively of the LED section 22 and of the electric terminal section 23 (see FIG. 3).

In FIG. 5A, part of the sheath 34 near the end of the cable 3 is peeled off to expose the shield 33.

In FIG. 5B, the substrate body 21 shown in FIG. 5A is accommodated in the housing body 26 and the exposed portion of the shield 33 is fixed, by means of a fastener 27, to one edge 260 of the housing body 26.

FIG. 5C shows a sectional view of the cable 3 taken at the place where the cable 3 is fixed by the fastener 27 to the edge 260 of the housing body 26.

As shown in FIG. 5C, since the shield 33 of the cable 3 is connected to the metallic housing body 26 of the connector 2, the connector 2 can make a good ground for electric current through the cable 3, thereby suppressing negative effect due to electromagnetic noise.

According to the above-described exemplary embodiment, the connector 2 is connected to the cable 3 through insertion of the ferrule 30 into the engagement portions 22*a* and 23*a*. However, the present invention is not limited to the exemplary embodiment, and the connector 2 may be directly connected to the cable 3 without intervention of the ferrule 30. Alternatively, the cable 3 may not be covered with a shield or may not be connected to the housing body 26 with the fastener 27.

The foregoing description of the exemplary embodiment(s) of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A data link module comprising:

a cable comprising a bundle formed by combining an electric wire and a plurality of optical fibers aligned with each other;

a substrate disposed at one end of the cable, the one end face of the substrate facing a direction that the cable extends;

a plurality of signal medium conversion elements performing conversion between an electric signal and an optical signal, the signal medium conversion elements being arranged in one of a top face and a back face of the substrate, at a position substantially close to the one end face of the substrate where the signal medium conversion elements are optically connected to ends of the optical fibers of the cable respectively;

an electric terminal that is arranged at the other one of the top face and the back face of the substrate, at a position substantially close to the one end face of the substrate so as to correspond to and be electrically connected to the electric wire of the cable; and an electric connector that is adapted to be connected with a mating electrical connector, the electrical connector being disposed at a position substantially close to an end face opposite to the one end face of the substrate and is electrically connected to the signal medium conversion elements and the electric terminal respectively.

2. The data link module according to claim 1, further comprising:

a ferrule defining an insertion hole for the optical fiber that tips of the optical fibers at the one end of the cable are inserted into and an insertion hole for the electrical wire that a tip of the electrical wire of the cable at the one end of the cable is inserted into; and an engagement portion that engages with the ferrule fixed to the substrate, and causes the optical fibers to be optically connected to the signal medium conversion elements respectively and the electrical wire to be electrically connected to the electrical terminal.

3. The data link module according to claim 1, further comprising:

a shield provided in the cable that covers, in whole, the electrical wire and the optical fibers of the cable;

a metallic housing that covers the substrate; and a connection member that connects the shield to the housing.

* * * * *